US008434461B2

(12) United States Patent
Kerns et al.

(10) Patent No.: US 8,434,461 B2
(45) Date of Patent: May 7, 2013

(54) METHOD AND SYSTEM FOR FUEL VAPOR CONTROL

(75) Inventors: James Michael Kerns, Trenton, MI (US); Chris Kragh, Commerce Township, MI (US); Dennis Yang, Canton, MI (US); Timothy DeBastos, Royal Oak, MI (US); Russell Randall Pearce, Ann Arbor, MI (US); Scott Bohr, Plymouth, MI (US); Michael G. Heim, Brownstown, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 124 days.

(21) Appl. No.: 13/097,408

(22) Filed: Apr. 29, 2011

(65) Prior Publication Data

US 2011/0265768 A1 Nov. 3, 2011

(51) Int. Cl.
*F02M 33/02* (2006.01)

(52) U.S. Cl.
USPC ..... 123/521; 123/520

(58) Field of Classification Search ..... 123/521, 123/520, 698
See application file for complete search history.

(56) References Cited

U.S. PATENT DOCUMENTS

| | | | | |
|---|---|---|---|---|
| 5,021,071 | A * | 6/1991 | Reddy | 95/106 |
| 5,647,332 | A * | 7/1997 | Hyodo et al. | 123/519 |
| 5,669,360 | A * | 9/1997 | Hyodo et al. | 123/520 |
| 6,079,393 | A * | 6/2000 | Tsutsumi et al. | 123/478 |
| 6,796,295 | B2 * | 9/2004 | Kidokoro et al. | 123/520 |
| 7,047,952 | B1 * | 5/2006 | Yamauchi et al. | 123/519 |
| 7,086,392 | B2 | 8/2006 | Suzuki | |
| 8,056,540 | B2 * | 11/2011 | DeBastos et al. | 123/521 |
| 2008/0179121 | A1 | 7/2008 | Sauvlet et al. | |
| 2010/0011746 | A1 * | 1/2010 | Lupescu | 60/278 |
| 2010/0012098 | A1 * | 1/2010 | Kobayashi | 123/519 |
| 2010/0050995 | A1 * | 3/2010 | Kobayashi | 123/521 |
| 2010/0132676 | A1 * | 6/2010 | Kitamura et al. | 123/520 |
| 2011/0247595 | A1 * | 10/2011 | Ogita et al. | 123/521 |

* cited by examiner

*Primary Examiner* — Mahmoud Gimie
*Assistant Examiner* — David Hamaoui
(74) *Attorney, Agent, or Firm* — Julia Voutyras; Alleman Hall McCoy Russell & Tuttle LLP

(57) ABSTRACT

Methods and systems are provided for operating a fuel vapor recovery system having a fuel tank isolation valve coupled between a fuel tank and a canister. Fuel vapors are purged from the fuel tank to a canister buffer over a plurality of purge pulses. The pulses are adjusted based on the buffer capacity, a purge flow rate, and a fuel tank pressure to improve control of canister loading and reduce air-to-fuel ratio disturbances.

20 Claims, 7 Drawing Sheets

METHOD AND SYSTEM FOR FUEL VAPOR CONTROL

FIELD

The present application relates to fuel vapor purging in vehicles, such as hybrid vehicles.

BACKGROUND AND SUMMARY

Reduced engine operation times in hybrid vehicles, such as plug-in hybrid vehicles, enable fuel economy and reduced fuel emissions benefits. However, the shorter engine operation times can lead to insufficient purging of fuel vapors from the vehicle's emission control system. To address this issue, hybrid vehicles may include a fuel tank isolation valve (FTIV) between a fuel tank and a hydrocarbon canister of the emission system to limit the amount of fuel vapors absorbed in the canister. Engine control systems may coordinate fuel tank pressure relief with refueling and canister purging operations to enable emissions control.

One example approach of emissions control is shown by Kidokoro et al. in U.S. Pat. No. 6,796,295. Therein, during engine operation, the FTIV is opened if a fuel tank pressure exceeds a limit and if the canister purge rate is higher than a threshold, to return the tank pressure near atmospheric pressure values.

However, the inventors herein have identified a potential issue with such an approach. As one example, air-to-fuel ratio disturbances may arise since canister loading may be more variable (and less predictable) than canister unloading. The disturbances may be exacerbated during lower canister purge rate conditions. Specifically, since the FTIV is kept open until the desired fuel tank pressure is reached, the amount of fuel vapors bled from the fuel tank to the canister may vary unpredictably. For example, there may be sudden fuel vapor spikes during the unloading of fuel vapors from the canister. In one example, the fuel vapor spikes from the fuel tank may overload the canister leading to higher air-to-fuel ratio disturbances and degraded exhaust emissions.

Thus in one example, the above issue may be at least partly addressed by a method of operating a fuel vapor recovery system. In one example embodiment, the method comprises, purging fuel vapors from a canister to an engine intake to reduce a stored fuel vapor amount in the canister, and intermittently purging fuel vapors from a fuel tank to the canister to increase a stored fuel vapor amount in a canister buffer. Further, a duration and interval of the intermittent purging may be based on the stored fuel vapor amount in the buffer.

By adjusting the purging from the fuel tank based on a buffer capacity, loading of fuel vapors from the fuel tank to the buffer may be better controlled. In particular, by delivering fuel vapors as multiple purge pulses, rather than as a single purge, with each pulse adjusted based on the buffer capacity, buffer loading may be better controlled and air-to-fuel ratio disturbances may be reduced. By cyclically unloading a canister buffer before loading the buffer with fuel vapors from the fuel tank, purging of fuel vapors from the fuel tank may be better coordinated with purging of fuel vapors from the canister.

In one example, an engine may include a fuel vapor recovery system with a fuel tank isolation valve coupled between a fuel tank and a canister, and a canister purge valve coupled between the canister and the engine intake. During purging conditions, the canister purge valve may be opened, while the isolation valve is maintained closed, to purge fuel vapors from the canister to the engine intake until the amount of fuel vapors in the canister is below a threshold (e.g., until the canister is empty). As such, the canister may have a buffer region that is purged towards the end of the canister purging operation such that when the amount of fuel vapors in the canister is below the threshold, an amount of fuel vapors in the buffer is also reduced and a capacity of the buffer is increased above a threshold capacity.

When the amount of fuel vapors in the canister is below the threshold (e.g., empty), and the buffer capacity has increased, the fuel tank isolation valve may be intermittently opened (or pulsed) to purge fuel vapors from the fuel tank to the canister, specifically, to the buffer region of the canister. The total amount of fuel vapors that are purged from the fuel tank to the buffer may be based on the buffer capacity to allow the buffer to be refilled with fuel vapors, but not overfilled. The duration of each pulse, as well as an interval between consecutive pulses may be adjusted based on the amount of fuel vapors stored in the buffer (or the buffer capacity) at the onset of the intermittent purging from the fuel tank. The duration of pulses and/or interval between pulses may also be adjusted based on a fuel tank pressure at the onset of the intermittent opening, as well as canister purge rate.

In this way, overloading of the buffer is reduced, and overflow of fuel vapors from the buffer into the canister is reduced. By further adjusting the pulses based on the fuel tank pressure, fuel tank pressure may be maintained within limits without causing air-to-fuel ratio disturbances. As such, this leads to improved exhaust emissions.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
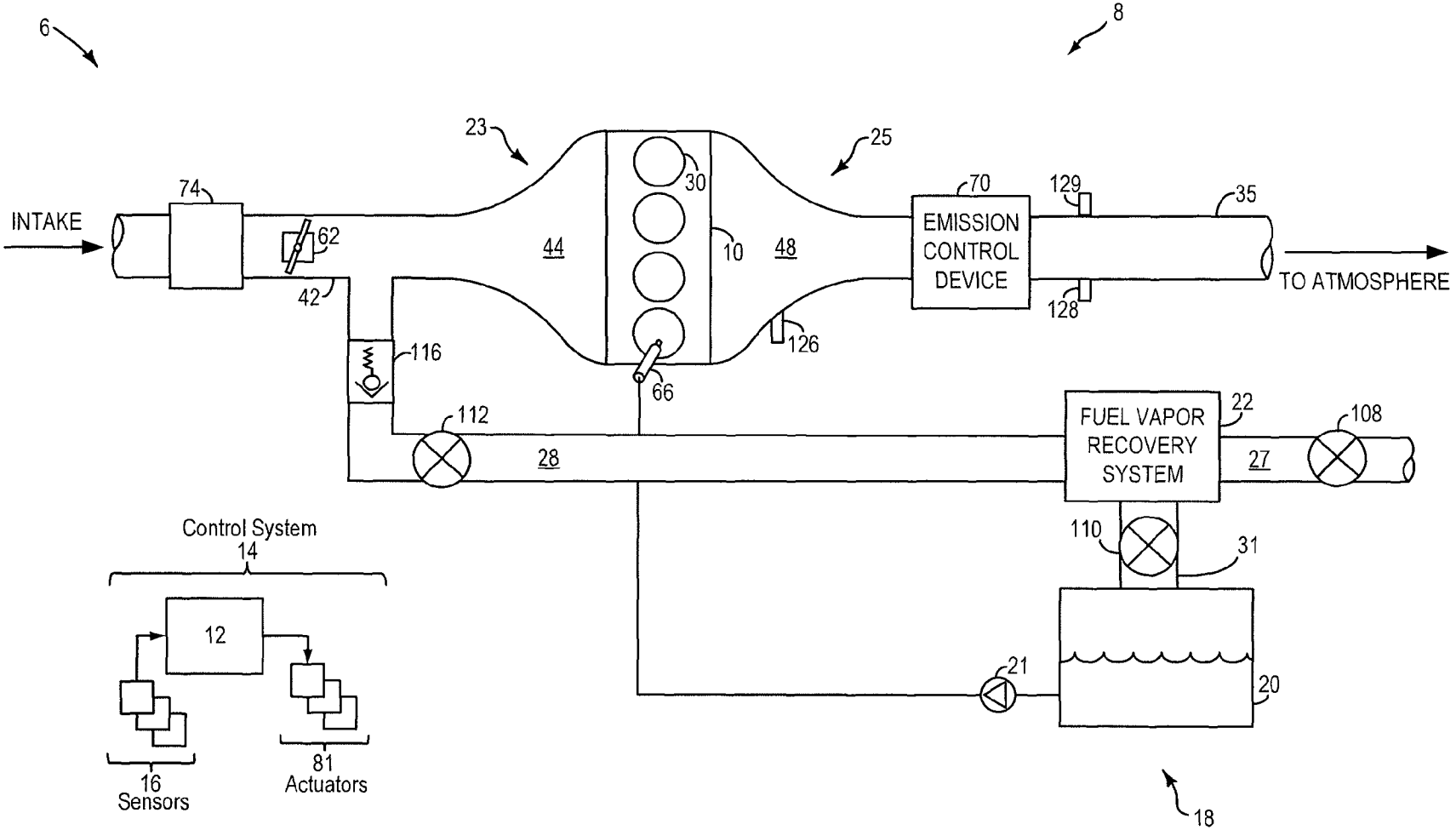
FIG. 1 shows a schematic depiction of an engine and an associated fuel vapor recovery system.
Figure 2:
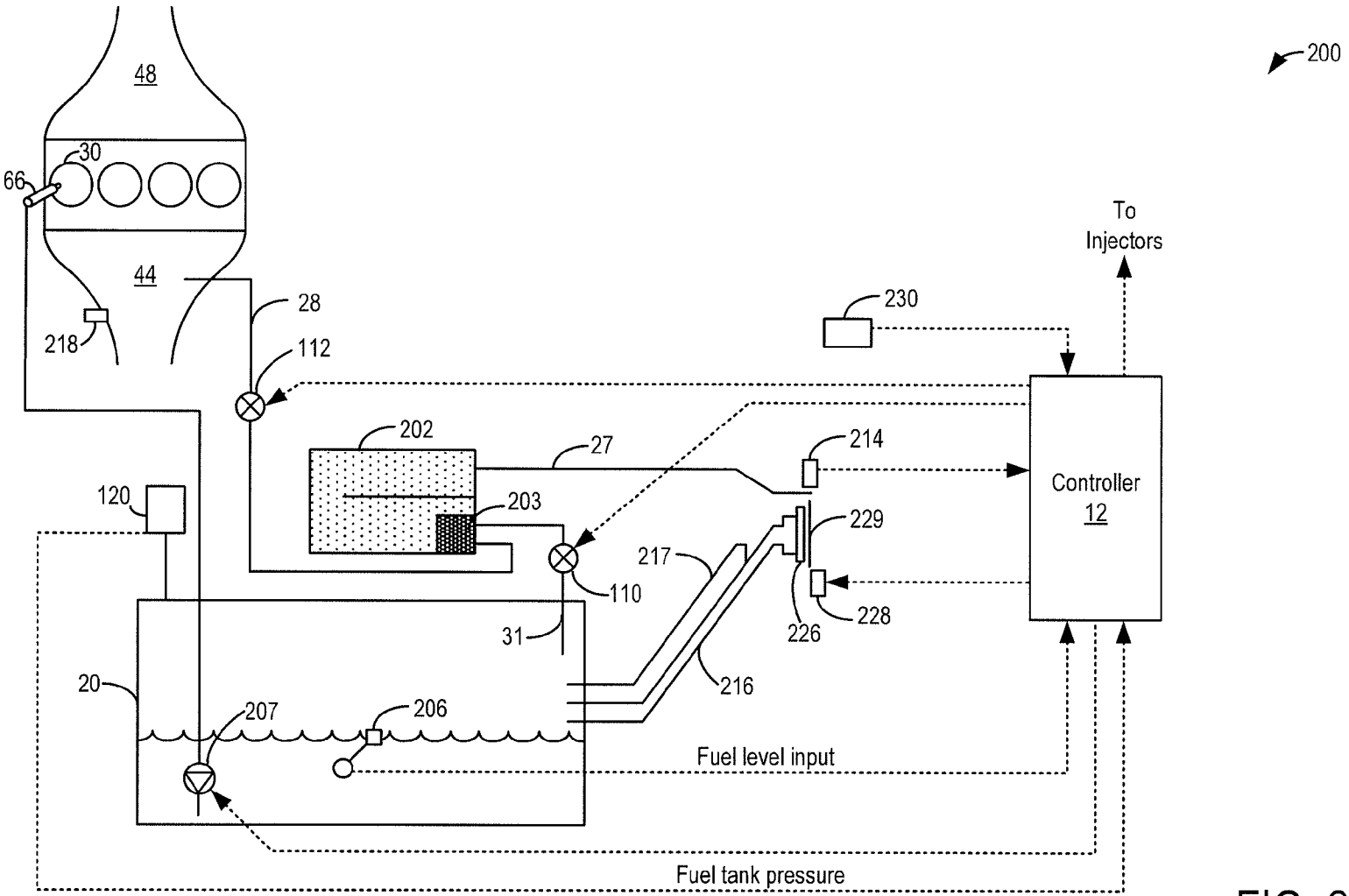
FIG. 2 shows an embodiment of the fuel vapor recovery system of FIG. 1.
Figure 6:
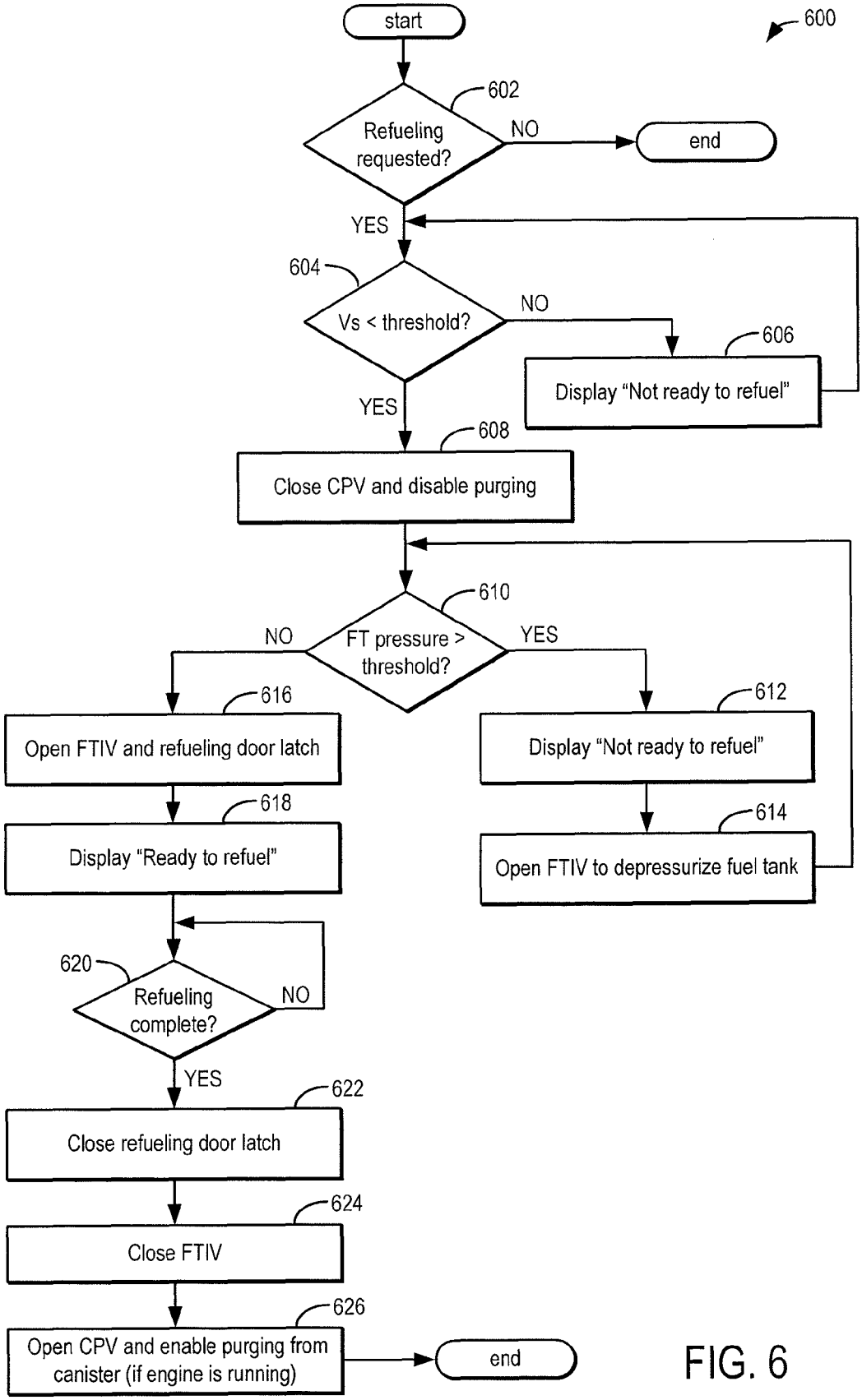
FIG. 6 shows a high level flow chart illustrating a refueling routine for the fuel vapor recovery system of FIG. 1.
Figure 7:
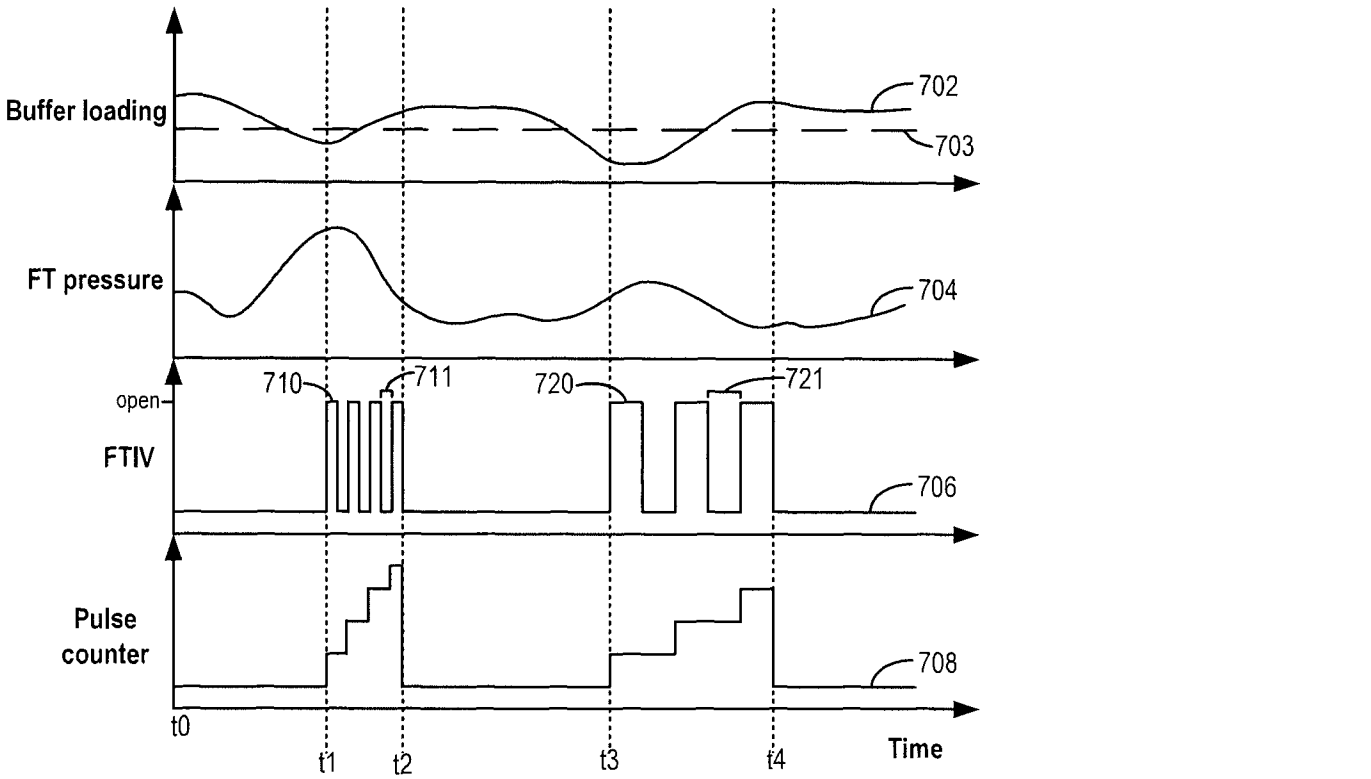
FIG. 7 shows an example map of fuel vapor purging from a fuel tank based on a buffer capacity and a fuel tank pressure.

The following description relates to systems and methods for operating a fuel vapor recovery system, such as the system of FIG. 2, coupled to an engine system, such as the engine system of FIG. 1. During purging conditions, a purge valve may be opened to purge fuel vapors stored in a canister to the engine intake. Following the purging from the canister, a fuel tank isolation valve (FTIV) of the fuel vapor recovery system may be intermittently opened to purge fuel vapors from the fuel tank to a buffer region of the canister over a number of purge pulses. A duration of each purge pulse, as well as an interval between consecutive pulses may be adjusted based on the buffer capacity, purge flow rate, and the fuel tank pressure (e.g., at the onset of the pulsing). An engine controller may be configured to perform control routines, such as those depicted in FIGS. 3-5, to adjust the duration of, and interval between, the pulses and coordinate purging from the canister to the engine intake, with purging from the fuel tank to the canister. The controller may be further configured to perform a control routine, such as depicted in FIG. 6, to depressurize the fuel tank before enabling a fuel tank refilling operation. An example map of a purging operation is illustrated in FIG. 7. In this way, by better controlling unloading of a fuel tank and loading of a canister, overfilling and air-to-fuel ratio disturbances may be reduced, thereby improving vehicle emissions control.

FIG. 1 shows a schematic depiction of a hybrid vehicle system 6 that can derive propulsion power from engine system 8 and/or an on-board energy storage device (not shown), such as a battery system. An energy conversion device, such as a generator (not shown), may be operated to absorb energy from vehicle motion and/or engine operation, and then convert the absorbed energy to an energy form suitable for storage by the energy storage device.

Engine system 8 may include an engine 10 having a plurality of cylinders 30. Engine 10 includes an engine intake 23 and an engine exhaust 25. Engine intake 23 includes a throttle 62 fluidly coupled to the engine intake manifold 44 via an intake passage 42. Engine exhaust 25 includes an exhaust manifold 48 leading to an exhaust passage 35 that routes exhaust gas to the atmosphere. Engine exhaust 25 may include one or more emission control devices 70 mounted in a close-coupled position. The one or more emission control devices may include a three-way catalyst, lean NOx trap, diesel particulate filter, oxidation catalyst, etc. It will be appreciated that other components may be included in the engine such as a variety of valves and sensors, as further elaborated in the example embodiment of FIG. 2.

In some embodiments, engine intake 23 may further include a boosting device, such as a compressor 74. Compressor 74 may be configured to draw in intake air at atmospheric air pressure and boost it to a higher pressure. As such, the boosting device may be a compressor of a turbocharger, where the boosted air is introduced pre-throttle, or the compressor of a supercharger, where the throttle is positioned before the boosting device. Using the boosted intake air, a boosted engine operation may be performed.

Engine system 8 may be coupled to a fuel vapor recovery system 22 and a fuel system 18. Fuel system 18 may include a fuel tank 20 coupled to a fuel pump system 21. Fuel tank 20 may hold a plurality of fuel blends, including fuel with a range of alcohol concentrations, such as various gasoline-ethanol blends, including E10, E85, gasoline, etc., and combinations thereof. Fuel pump system 21 may include one or more pumps for pressurizing fuel delivered to the injectors of engine 10, such as example injector 66. While only a single injector 66 is shown, additional injectors are provided for each cylinder. It will be appreciated that fuel system 18 may be a return-less fuel system, a return fuel system, or various other types of fuel system. Vapors generated in fuel system 18 may be routed to fuel vapor recovery system 22, described further below, via conduit 31, before being purged to the engine intake 23.

Fuel vapor recovery system 22 may include one or more fuel vapor recovery devices, such as one or more canisters, filled with an appropriate adsorbent, for temporarily trapping fuel vapors (including vaporized hydrocarbons) generated during fuel tank refilling operations, as well as diurnal vapors. In one example, the adsorbent used is activated charcoal. When purging conditions are met (FIGS. 3-5), such as when the canister is saturated, vapors stored in fuel vapor recovery system 22 may be purged to engine intake 23 by opening canister purge valve 112.

Fuel vapor recovery system 22 may further include a vent 27 with valve 108 which may route gases out of the recovery system 22 to the atmosphere when storing, or trapping, fuel vapors from fuel system 18. Vent 27 and valve 108 may also allow fresh air to be drawn into fuel vapor recovery system 22 when purging stored fuel vapors from fuel system 18 to engine intake 23 via purge line 28 and purge valve 112. A canister check valve 116 may be optionally included in purge line 28 to prevent (boosted) intake manifold pressure from flowing gases into the purge line in the reverse direction. While this example shows vent 27 communicating with fresh, unheated air, various modifications may also be used. A detailed system configuration of fuel vapor recovery system 22 is described herein below with regard to FIG. 2, including various additional components that may be included in the intake, exhaust, and fuel system.

As such, hybrid vehicle system 6 may have reduced engine operation times due to the vehicle being powered by engine system 8 during some conditions, and by the energy storage device under other conditions. While the reduced engine operation times reduce overall carbon emissions from the vehicle, they may also lead to insufficient purging of fuel vapors from the vehicle's emission control system. To address this, fuel tank 20 may be designed to withstand high fuel tank pressures. In particular, a fuel tank isolation valve (FTIV) 110 is included in conduit 31, between fuel tank 20 and fuel vapor recovery system 22. FTIV 110 may normally be kept closed to limit the amount of fuel vapors absorbed in the canister from the fuel tank. Specifically, the normally closed FTIV separates storage of refueling vapors from the storage of diurnal vapors, and is opened during refueling and purging operations to allow refueling vapors to be directed to the canister. In one example, the normally closed FTIV is opened only during refueling and purging (e.g., if the fuel tank pressure is higher than a threshold) to allow refueling vapors to be directed to a buffer region of the canister. Further, in one example, FTIV 110 may be a solenoid valve and operation of FTIV 110 may be regulated by adjusting a driving signal to the dedicated solenoid (not shown). In some embodiments, fuel tank 20 may also be constructed of material that is able to structurally withstand high fuel tank pressures, such as fuel tank pressures that are higher than a threshold and below atmospheric pressure.

One or more pressure sensors (FIG. 2) may be included upstream and/or downstream of FTIV 110 to provide an estimate of a fuel tank pressure. One or more oxygen sensors (FIG. 2) may be provided downstream of the canister, in the engine intake, and/or in the exhaust, to provide an estimate of the buffer capacity. As elaborated in FIGS. 3-5, during purging conditions, fuel vapors may first be purged from the canister to the engine intake 23 to reduce the stored fuel vapor amount in the canister below a threshold (e.g., until the canister is empty or until a canister buffer capacity is higher than a threshold). After the stored fuel vapor amount has reached below the threshold, the FTIV 110 may be intermittently opened, or pulsed, to intermittently purge fuel vapors from the fuel tank to a canister buffer to increase a stored fuel vapor amount in the buffer. In one example, the FTIV may be opened after the canister has been purged only if the fuel tank pressure is higher than a calibrated threshold pressure, and may remain open until the pressure has dropped below the calibrated threshold. A duration of each purge pulse, as well as an interval between consecutive purge pulses may be adjusted based on a buffer capacity, a canister purge valve flow rate, and a fuel tank pressure (e.g., estimated at the onset of the pulsing). By adjusting the length of each pulse and a gap between pulses, fuel vapors from the fuel tank may be better delivered to the buffer, thereby reducing buffer overfilling and air-to-fuel ratio disturbances.

Vehicle system 6 may further include control system 14. Control system 14 is shown receiving information from a plurality of sensors 16 (various examples of which are described herein) and sending control signals to a plurality of actuators 81 (various examples of which are described herein). As one example, sensors 16 may include exhaust gas sensor 126 located upstream of the emission control device, temperature sensor 128, and pressure sensor 129. Other sensors such as additional pressure, temperature, air/fuel ratio, and composition sensors may be coupled to various locations in the vehicle system 6, as discussed in more detail in FIG. 2. As another example, the actuators may include fuel injector 66, FTIV 110, purge valve 112, and throttle 62. The control system 14 may include a controller 12. The controller may receive input data from the various sensors, process the input data, and trigger the actuators in response to the processed input data based on instruction or code programmed therein corresponding to one or more routines. Example control routines are described herein with regard to FIGS. 3-6.

FIG. 2 shows an example embodiment 200 of fuel vapor recovery system 22. Fuel vapor recovery system 22 may include one or more fuel vapor retaining devices, such as fuel vapor canister 202. Canister 202 may include a buffer 203 (or buffer region), each of the canister and the buffer comprising an adsorbent. The adsorbent in the buffer 203 may be same as, or different from, the adsorbent in the canister (e.g., both may include charcoal). Buffer 203 may be positioned within canister 202 such that during canister loading, fuel vapors are first adsorbed within the buffer, and then when the buffer is saturated, further fuel vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing any fuel vapor spikes from going to the engine.

Canister 202 may receive fuel vapors from fuel tank 20 through conduit 31. During regular engine operation, FTIV 110 may be kept closed to limit the amount of diurnal vapors directed to canister 202 from fuel tank 20. During refueling operations, and selected purging conditions, FTIV 110 may be temporarily, and intermittently, opened to direct fuel vapors from the fuel tank to buffer 203. While the depicted example shows FTIV 110 positioned along conduit 31, in alternate embodiments, the tank isolation valve may be mounted on the fuel tank.

One or more pressure sensors may be coupled to fuel tank 20 for estimating a fuel tank pressure. While the depicted example shows pressure sensor 120 coupled to fuel tank 20, in alternate embodiments, the pressure sensor may be coupled between the fuel tank and FTIV 110. In still other embodiments, a first pressure sensor may be positioned upstream of FTIV 110, while a second pressure sensor is positioned downstream of FTIV 110, to provide an estimate of a pressure difference across the FTIV.

A fuel level sensor 206 located in fuel tank 20 may provide an indication of the fuel level ("Fuel Level Input") to controller 12. As depicted, fuel level sensor 206 may comprise a float connected to a variable resistor. Alternatively, other types of fuel level sensors may be used. Fuel tank 20 may further include a fuel pump 207 for pumping fuel to injector 66.

Fuel tank 20 receives fuel via refueling line 216, which acts as a passageway between the fuel tank 20 and a refueling door 229 on the outer body of the vehicle. During a fuel tank refilling event, fuel may be pumped into the vehicle from an external source through refueling door 229 and fuel lid 226. In response to a refueling request, such as when a vehicle operator actuates fuel lid opener switch 230, an engine controller may be configured to maintain a fuel door latch 228 closed until fuel tank vapors have been bled to the canister buffer and a fuel tank pressure has been reduced. As such, while fuel door latch 228 is closed, refueling door 229 cannot be opened, fuel lid 226 is inaccessible, and fuel tank 20 cannot be refilled. Once the fuel tank has been depressurized, the controller may open fuel door latch 228 to enable fuel tank refilling. Specifically, when fuel door latch 228 is opened, refueling door 229 can be opened, and fuel tank 20 can be refilled via fuel lid 226. Following refueling, such as when the refuel door 229 has been closed and fuel lid 226 has been secured, controller 12 may close fuel door latch 228. A fuel lid sensor 214 coupled to fuel lid 226 may be configured to indicate that the refueling door 229 has been closed and the fuel lid 226 has been secured at the end of the refueling operation. In one example, fuel lid sensor 214 may be a position sensor that sends input signals regarding an open or closed state of the refueling door, or fuel lid, to controller 12. In some embodiments, refueling line 216 may further include a parallel refueling vapor line 217 for directing refueling vapors to a refueling expansion cup (not shown).

Canister 202 may communicate with the atmosphere through vent 27. Vent 27 may include an optional canister vent valve (not shown) to adjust a flow of air and vapors between canister 202 and the atmosphere. The canister vent valve may also be used for diagnostic routines. When included, the vent valve may be opened during fuel vapor storing operations (for example, during fuel tank refilling and while the engine is not running) so that air, stripped of fuel vapor after having passed through the canister, can be pushed out to the atmosphere Likewise, during purging operations (for example, during canister regeneration and while the engine is running), the vent valve may be opened to allow a flow of fresh air to strip the fuel vapors stored in the canister.

Fuel vapors released from canister 202, for example during a purging operation, may be directed into engine intake manifold 44 via purge line 28. The flow of vapors along purge line 28 may be regulated by canister purge valve 112, coupled between the fuel vapor canister and the engine intake. The quantity and rate of vapors released by the canister purge valve may be determined by the duty cycle of an associated canister purge valve solenoid (not shown). As such, the duty cycle of the canister purge valve solenoid may be determined by the vehicle's powertrain control module (PCM), such as controller 12, responsive to engine operating conditions, including, for example, an air-fuel ratio. By commanding the canister purge valve to be closed, the controller may seal the fuel vapor recovery system from the engine intake.

An optional canister check valve may be included in purge line 28 to prevent intake manifold pressure from flowing gases in the opposite direction of the purge flow. As such, the check valve may be necessary if the canister purge valve control is not accurately timed or the canister purge valve itself can be forced open by a high intake manifold pressure. An estimate of the manifold absolute pressure (MAP) may be obtained from MAP sensor 218 coupled to intake manifold 44, and communicated with controller 12. Alternatively, MAP may be inferred from alternate engine operating conditions, such as mass air flow (MAF), as measured by a MAF sensor (not shown) coupled to the intake manifold. The check valve may be positioned between the canister purge valve and the intake manifold, or may be positioned before the purge valve.

As elaborated in FIGS. 3-6, the fuel vapor recovery system 22 may be operated by controller 12 in a plurality of modes by selective adjustment of the various valves and solenoids. For example, the fuel vapor recovery system may be operated in a fuel vapor storage mode (e.g., during a fuel tank filling operation and with the engine not running), wherein the controller 12 may open FTIV 110 while closing canister purge valve (CPV) 112 to direct refueling vapors into canister 202 while preventing fuel vapors from being directed into the intake manifold.

As another example, the fuel vapor recovery system may be operated in a canister purging mode (e.g., after an emission control device light-off temperature has been attained and with the engine running), wherein the controller 12 may open canister purge valve 112 while closing FTIV 110. Herein, the vacuum generated by the intake manifold of the operating engine may be used to draw fresh air through vent 27 and through fuel vapor canister 202 to purge the stored fuel vapors into intake manifold 44. In this mode, the purged fuel vapors from the canister are combusted in the engine. The purging may be continued until the stored fuel vapor amount in the canister (or canister buffer) is below a threshold. In an alternate embodiment, rather than using fresh air that is at atmospheric pressure, compressed air that has been passed through a boosting device (such as a turbocharger or a supercharger) may be used for a boosted purging operation. As such, fuel vapor recovery system 22 may require additional conduits and valves for enabling a boosted purging operation. During purging, the learned vapor amount/concentration can be used to determine the amount of fuel vapors stored in the canister and/or buffer, and then, during a later portion of the purging operation (when the canister is sufficiently purged or empty), the learned vapor amount/concentration can be used to estimate a loading state of the fuel vapor canister and/or a buffer capacity. In one example, only after a threshold amount of fuel vapors have been purged from the canister to the intake, and the buffer capacity has been increased above a threshold capacity, an amount of diurnal fuel vapors may be purged from the fuel tank to the buffer by intermittently opening the FTIV.

As still another example, the fuel vapor recovery system may be operated in a fuel tank purging mode (e.g., after the canister has been purged long enough to reduce a loading state of the canister below a threshold amount of stored fuel vapors), wherein the controller 12 may intermittently open FTIV 110 while maintaining canister purge valve 112 open. As such, when the stored fuel vapor amount in the canister is below the threshold amount, the stored fuel vapor amount in the buffer may also be below a threshold amount (e.g., a different threshold amount), and the buffer capacity may be higher than a threshold capacity. A duration of each intermittent opening of the FTIV, as well as an interval between consecutive openings may be adjusted based on a fuel tank pressure, canister purge valve flow rate, and a buffer capacity, as estimated at the onset of the fuel tank purging mode, to purge an amount of fuel vapors from the fuel tank to the buffer over a plurality of FTIV pulses.

As yet another example, the fuel vapor recovery system may be operated in a refueling mode (e.g., when fuel tank refilling is requested by a vehicle operator), wherein the controller 12 may open FTIV 110, while maintaining canister purge valve 112 closed, to depressurize the fuel tank before allowing enabling fuel to be added therein. As such, FTIV may be kept open during the refueling operation to allow refueling vapors to be stored in the canister buffer. After refueling is completed, the FTIV may be closed.

Figure 3:
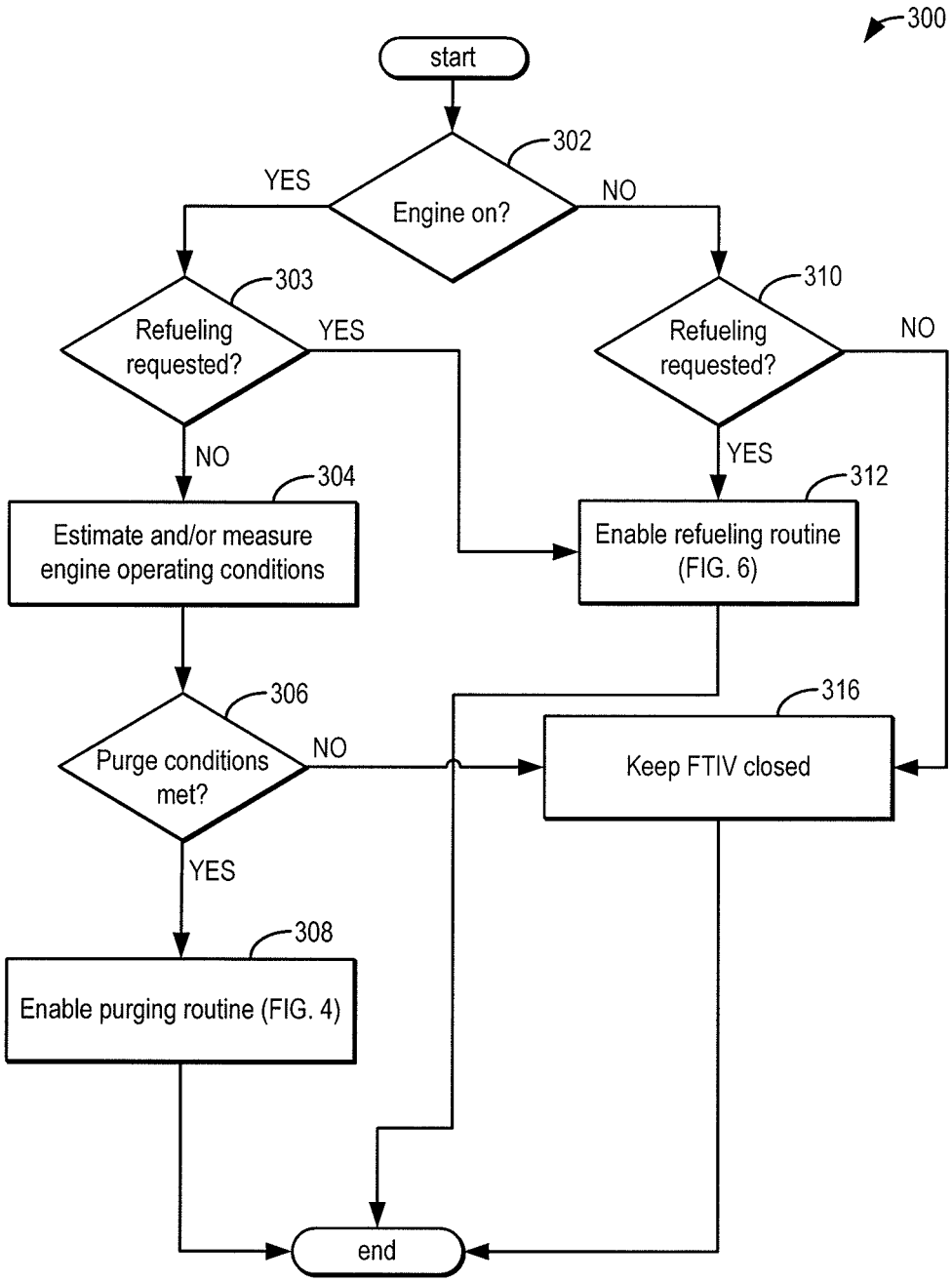
FIG. 3 shows a high level flow chart illustrating a routine for operating the fuel vapor recovery system of FIG. 1.

Now turning to FIG. 3, an example routine 300 is described for coordinating various fuel vapor recovery system operations based on vehicle operating conditions.

At 302, it may be determined whether the vehicle is on and the engine is running. As such, purging operations may be performed only if the engine is running, while refueling operations may be initiated whether the engine is running or not running. If the engine is running, then at 303, it may be determined if refueling has been requested. In one example, refueling may be requested during engine running if the vehicle operator actuates a fuel lid opener switch while the vehicle is running. If yes, a refueling routine, as elaborated at FIG. 6), may be initiated at 312.

If no refueling is requested, then at 304, engine operating conditions may be estimated and/or measured. These may include, for example, engine speed, manifold pressure (MAP), barometric pressure (BP), catalyst temperature, canister load, fuel tank pressure, etc. At 306, purge conditions may be confirmed. As such, purging may be confirmed based on various engine and vehicle operating parameters, including the amount of hydrocarbons stored in the canister (such as the amount of hydrocarbons stored in the canister being greater than a threshold), the temperature of the emission control device (such as the temperature being greater than a threshold), fuel temperature, the number of starts since the last purge (such as the number of starts being greater than a threshold), fuel properties (such as the alcohol amount in the combusted fuel, the frequency of purging increased as an alcohol amount in the fuel increases), and various others. In another example, purge conditions may be confirmed if the controller determines that fuel vapors were directed to the canister during a preceding engine cycle. If purging conditions are not confirmed, the routine may end. If confirmed, at 308, a purging routine, as elaborated in FIG. 4, may be enabled.

If the engine is not running (at 302), then at 310, as at 303, it may be determined whether refueling has been requested. In one example, refueling may be requested by the vehicle operator by actuating the fuel lid opener switch while the vehicle is stopped and the engine is not running. If requested, a refueling routine may be initiated at 312. As elaborated in FIG. 6, the refueling routine may be initiated differently (e.g., with different delays) based on a vehicle speed at the time of the refueling request. However, the refueling may occur only with the vehicle stopped, irrespective of whether the engine is running or not.

If purging is not requested (with the engine running) at 306, or refueling is not requested (with the engine not running) at 310, then at 316, the fuel tank isolation valve (FTIV) may be maintained closed to contain diurnal fuel vapors in the fuel tank, separate from the canister.

Figure 4:
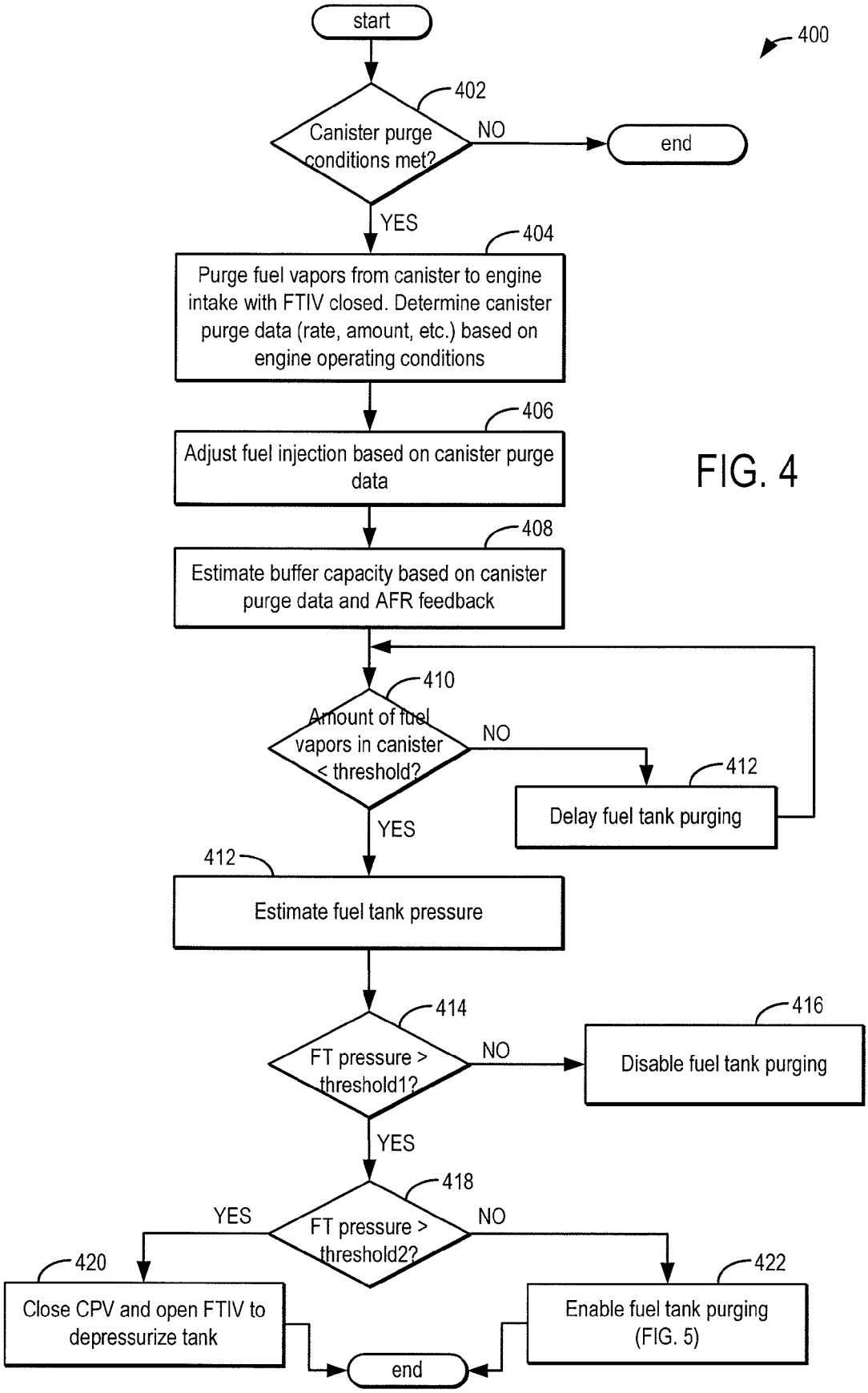
FIGS. 4-5 shows high level flow charts illustrating purging routines for purging fuel vapors from the canister and the fuel tank of the fuel vapor recovery system of FIG. 1.

Now turning to FIG. 4, an example routine 400 is described for coordinating a canister purging operation (wherein fuel vapors are purged from the canister to the engine intake) with a fuel tank purging operation (wherein fuel vapors are purged from the fuel tank to the canister buffer) based on a buffer capacity, canister purge valve flow rate, and a fuel tank pressure.

At 402, purge conditions may be confirmed, else the routine may end. Upon confirmation of purge conditions, at 404, the routine includes purging fuel vapors from the canister to the engine intake to reduce a stored fuel vapor amount in the canister and increase a buffer capacity. Herein, purging fuel vapors from the canister includes closing a fuel tank isolation valve coupled between the fuel tank and the canister and opening a canister purge valve coupled between the canister and the engine intake. Canister purge data (e.g., canister purge rate, duration, purge valve duty cycle, etc.) may be based on engine operating conditions. These may include, for example, mass air flow (MAF), manifold air pressure (MAP), a desired air-to-fuel ratio, air-to-fuel ratio feedback from an oxygen sensor and/or hydrocarbon sensor coupled downstream of the canister, etc. The canister purge data may also be based on a loading state of the canister (that is, amount/concentration of fuel vapors stored in the canister), as learned during a canister loading operation immediately preceding the canister purging operation.

At 406, based on the canister purge data (e.g., the canister purge rate), a fuel injection to the engine cylinders may be adjusted to provide a desired air-to-fuel ratio. In one example, as the canister purge rate increases (that is, an amount of fuel vapors directed to the engine intake from the canister increases), an amount of fuel injected to the engine may be correspondingly decreased to maintain the desired air-to-fuel ratio (for example, at or around stoichiometry).

At 408, based on the canister purge data, a canister buffer capacity may be determined. In one example, the buffer capacity is estimated based on the canister purge rate, and rate of air flow through the canister. In another example, the buffer capacity is estimated based on air-to-fuel ratio feedback from an oxygen sensor and/or a hydrocarbon sensor coupled downstream of the canister. Since the buffer capacity is a function of the canister capacity, in another example, a fuel vapor amount stored in the canister may be learned during a previous canister loading or purging operation, and the buffer capacity at the beginning of the canister purging may be estimated based on the canister capacity at the beginning of the canister purging. The buffer capacity may then be further filtered downwards as a function of the canister purge duration, or purge volume. Still other multipliers may be used.

At 410, it may be confirmed that the stored fuel vapor amount in the canister is below a threshold. The stored amount of fuel vapors in the canister may be estimated based on the canister purge rate, a rate of air flow through the canister, and air-to-fuel ratio feedback from an oxygen sensor and/or hydrocarbon sensor downstream of the canister. Alternatively, the stored fuel vapor amount may be learned during a previous canister loading or purging operation and filtered down as a function of a canister purge duration, or purge volume. In one example, it may be confirmed that the canister is empty. In another example, the threshold may correspond to a condition wherein the buffer is empty As such, since the buffer capacity is a non-linear function of the canister capacity, purging fuel vapors from the canister to reduce the stored fuel vapor amount in the canister may include purging fuel vapors from the canister to the engine intake until a stored fuel vapor amount in the buffer is below a buffer threshold. If the amount of fuel vapors in the canister is above the threshold, at 412, fuel tank purging may be delayed and purging of fuel vapors from the canister to the engine intake may be continued, with the FTIV closed, until the stored fuel vapor amount in the canister is reduced below the threshold.

If the stored fuel vapor amount in the canister is below the threshold, then at 412, a fuel tank pressure may be estimated, for example, by a pressure sensor coupled to the fuel tank, or coupled between the fuel tank and the FTIV. At 414, it may be determined whether the estimated fuel tank pressure (or a filtered fuel tank pressure) is higher than a first, lower threshold (threshold 1). As such, the threshold pressure may be calibrated based on ambient conditions, such as an ambient temperature, or a fuel tank temperature. In some examples, the threshold pressure may also be adjusted based on the volatility of the fuel stored in the fuel tank (e.g., based on the alcohol content of the stored fuel). If the fuel tank pressure is not above the first threshold, then at 416, fuel tank purging may be disabled and the FTIV may not need to be opened to purge fuel vapors.

While the depicted embodiment illustrates delaying fuel tank purging if the fuel tank pressure is below the first threshold and enabling fuel tank purging if the fuel tank pressure is above the first threshold, in alternate embodiments, fuel tank purging may be enabled even if the fuel tank pressure is below the threshold. For example, fuel tank purging may be enabled following each canister purge wherein the stored fuel vapor amount in the canister has been reduced below the threshold. In one example, by bleeding the existing amount of fuel vapors to the buffer following a canister purge, even when the fuel tank pressure is not above the threshold, undesired fuel tank pressurization may be pre-empted.

Returning to 414, if the fuel tank pressure is above the first threshold, then at 418, it may be determined if the fuel tank pressure (or the filtered fuel tank pressure) is above a second, higher threshold (threshold 2). As such, the second, higher threshold pressure may correspond to a mechanical pressure limit above which the fuel tank and other fuel vapor recovery system components may incur mechanical damage.

If the fuel tank pressure is higher than the first threshold, but lower than the second threshold, then at 422, fuel tank purging may be enabled. As elaborated in FIG. 5, this includes intermittently purging fuel vapors from the fuel tank to the canister by intermittently opening the FTIV to increase the stored fuel vapor amount in the canister buffer. Herein, intermittently purging fuel vapors from the fuel tank to the buffer includes purging over a plurality of consecutive purge pulses. A duration and interval of the purge pulses may be adjusted based on the buffer capacity, canister purge valve flow rate, and fuel tank pressure at the onset of the fuel tank purging operation. In one example, pulsing (or intermittent opening) of the isolation valve, to purge fuel vapors from the fuel tank, may be initiated only if the stored fuel vapor amount in the canister, or canister buffer, is below the threshold.

In comparison, if the fuel tank pressure is above the second threshold at 418, the fuel vapor recovery system may be determined to be in an "emergency" mode wherein immediate reduction of fuel tank pressure may be necessary. Accordingly, at 420, the canister purge valve may be closed while the fuel tank isolation valve is opened for a duration to purge fuel vapors from the fuel tank to the buffer and depressurize the tank until the fuel tank pressure is within the desired range (e.g., at least lower than the second threshold). The canister purge valve may be reopened only after the fuel tank has sufficiently depressurized. In one example, the FTIV may be maintained open with the canister purge valve closed until the fuel tank pressure is returned within the desired range. In another example, the FTIV may be pulsed, with the canister purge valve closed. The duration and interval of the pulses may be based on the difference of the fuel tank pressure from the mechanical limit pressure. For example, as the fuel tank pressure gets closer to the mechanical limits, the duration of the pulse may be increased while the interval may or may not be increased, so as to not temporarily overload the buffer. In another example, as elaborated in FIG. 5, the duration and interval of the pulses may be based on the buffer capacity, to gradually bleed fuel vapors from the fuel tank to the buffer. In this way, when the fuel tank pressure exceeds a desired limit, fuel tank vapors may be purged from the fuel tank to the canister buffer to depressurize the fuel tank. By closing the canister purge valve, if the buffer is overfilled, fuel vapors may spill into the canister, but not into the engine intake, thereby reducing air-to-fuel ratio disturbances caused by fuel vapor spikes from the fuel tank.

During some conditions, such as during high underbody temperatures and fresh fuel intake, fuel vapor purging from the fuel tank (for tank depressurization) may not be able to keep up with fuel vapor generation. Consequently, the fuel tank pressure may get "stuck". To address this, in some embodiments, a rate of change in the fuel tank pressure may also be determined and used to adjust the duration and interval of the purge pulses to further improve fuel tank depressurization.

Figure 5:
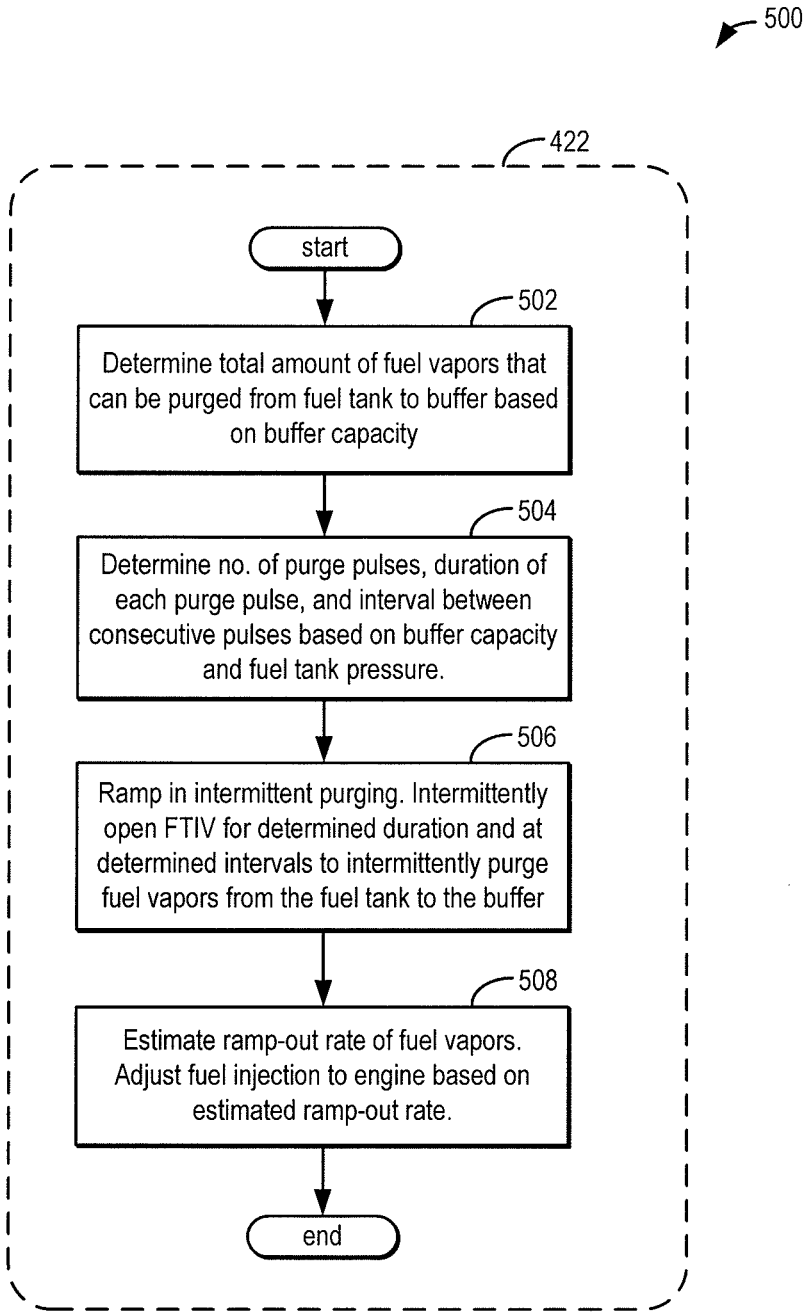

Now turning to FIG. 5, an example fuel tank purging routine 500 is described. As such, the routine of FIG. 5 may be performed as part of routine 400, specifically at 422, and optionally at 418.

At 502, a total amount of fuel vapors that can be purged from the fuel tank to the buffer is estimated based on the buffer capacity. In other words, the maximum pulse mass that can be contained within the buffer carbon is determined. Additionally, an FTIV pulse time that can deliver that mass may also be determined. As such, the maximum pulse mass that can be contained in the buffer carbon may be constrained by the existing fuel in the buffer (or carbon load of the buffer) and the current purge flow. The existing fuel in the buffer may be estimated as a function of the fuel fraction flowing from the buffer. If the buffer has a high amount of stored fuel vapors (that is, high loading or high fuel content), the fuel fraction out of the canister will also be high, and the capacity of the buffer to hold more fuel vapors is reduced. Thus, when the buffer has a higher fuel content, the total amount of fuel vapor that may be added to the buffer may be limited. Then, as the buffer capacity at the end of the canister purging increases, the amount of fuel vapors that may be purged from the fuel tank to the buffer increases.

At low purge flows, a large fuel vapor vent into the buffer can cause the fuel vapors to overflow from the buffer into the remainder of the carbon in the canister. In comparison, at higher purge flows, the fuel vapor vent may not sufficiently adsorbed by the carbon. Therefore, a base vent pulse mass is selected to be the lesser of the outputs from the two tables for fuel fraction and purge flow rate.

The total purge mass may be ramped in over a number of pulses, rather than as a single pulse, to limit the pulse mass in each pulse. As such, the mass of fuel in each pulse may also affect air-to-fuel ratio control. Longer pulses with larger intervals between pulses can cause oscillations in air-to-fuel ratio, and may be used more advantageously when the buffer capacity is higher and the fuel tank pressure is lower. In comparison, shorter and more frequent pulses may be better able to maintain a more steady state fuel load in the buffer and reduced air-to-fuel ratio disturbances. In one example, such pulses may be used more advantageously when the buffer capacity is lower and the fuel tank pressure is higher. Thus, the mass delivered in each pulse may be carefully adjusted to allow controlled buffer loading.

At 504, pulse data, such as the number of purge pulses, duration of purge pulses, and interval between purge pulses, may be determined so that the total purge amount to be vented from the fuel tank to the buffer may be ramped in. The pulse ramp in may be implemented via a pulse mass multiplier, or counter, that has an initial value that is increased with each fuel tank vent pulse. The number of pulses used to ramp in the total purge amount may be determined based on the requested purge flow rate at the time that the venting of fuel vapors from the fuel tank (that is, the tank pressure control operation) is enabled. In other words, the number of pulses used to ramp in the total purge amount may be determined as a function of the desired canister purge flow, since the canister continues to purge to the engine intake while the fuel tank purged to the buffer. At higher purge flows, the total amount of fuel tank vapors may be ramped in over more pulses. Herein, since the purging of the buffer is likely to have a larger impact on air-to-fuel ratio control, and the time between vent pulses may be lower, more pulses may be required to allow the fuel fraction to update.

As defined herein, a duration of the intermittent purging includes a duration from the beginning to the end of each purge pulse. Likewise, an interval of the intermittent purging includes an interval from the end of a purge pulse to the beginning of an immediately following purge pulse. The duration and interval of the purging (that is, of the intermittent opening of the FTIV) may be based on the amount of fuel vapors stored in the buffer (that is, buffer capacity) at the beginning of the intermittent purging from the fuel tank. The duration and interval may be further based on a fuel tank pressure that is also estimated at the beginning of the intermittent purging from the fuel tank. For example, the duration of the intermittent purging may be decreased and the interval between consecutive purgings may be increased as the stored fuel vapor amount in the buffer increases. As another example, the duration of the intermittent purging may be increased as the fuel tank pressure decreases. In another example, the interval between consecutive intermittent purging events may be based on a canister purge flow rate.

In one example, the duration and interval for pulses at different buffer capacities, canister purge valve flow rates and fuel tank pressure may be stored as a 2D map, or as a look-up table, that is accessed by the controller. Further, settings that can cause air-to-fuel ratio oscillations may be clipped in the table. The durations and intervals may also be provided as multiples of a minimum pulse duration, and/or minimum pulse interval. For example, the pulses may be delivered at, and as, multiples of 8 msec. The minimum pulse duration and/or interval may correspond to a minimum amount of time that will not cause air-to-fuel ratio oscillations. Likewise, the interval duration may be adjusted to be larger than at least a minimum interval which allows air-to-fuel ratio feedback (e.g., closed loop) to be received (e.g., from a downstream exhaust sensor) so that future pulse adjustments can be made.

At 506, the FTIV may be intermittently opened, or pulsed, for the determined duration and at the determined intervals to ramp in the intermittent purging, or venting, of fuel vapors from the fuel tank to the canister over the determined number of purge pulses, thereby increasing a stored fuel vapor amount in the canister buffer. While the ramping in of fuel vapors into the buffer is in progress, the controller may be configured to set a flag to hold the canister purge flow rate and not enable a canister purge flow increase. By holding the canister purge flow rate during the ramping in, disturbances that would be caused by changing both the purge rate and the purged fuel fraction, at the same time, may be reduced.

At 508, a fuel injection amount to the engine cylinders may be adjusted based on the rate of purging of fuel vapors from the canister and the buffer to the engine intake. In particular, the fuel injection amount may be adjusted based on an estimated ramp-out rate of additional fuel vapors. As such, when conditions for fuel tank venting are no longer met, fuel tank venting is immediately, and abruptly, discontinued. At the time that the tank pressure control operation is disabled, the purge fuel fraction is likely to be high from fuel vapors being purged from the buffer. However, since the buffer volume is smaller, it will purge quickly and the actual purge fraction from the canister will drop rapidly. To reduce the impact of this on air-to-fuel ratio control, the estimated purge fuel fraction due to tank pressure control may be removed over a short period of time using a calculated time constant and an estimate of what the fuel fraction would be without the effects of the tank pressure control. In other words, a fuel fraction reduction may be determined.

To estimate the fuel fraction reduction, it may be assumed that the additional fuel from the buffer will decay as a first order exponential system, as a function of the accumulated purge mass (and not time). The primary components of the first order exponential system may include a magnitude of the change (that is, delta fuel fraction) and the filter time constant. To estimate a time constant for the decay, the purge mass required to purge the buffer may be estimated, and then converted from flow domain to time domain using the canister purge flow rate. The algorithm used for the estimation may assume that the time constant for the buffer is proportional to the purge flow required to purge the buffer, and that was used to determine the time between tank vent pulses. That is, a purge mass multiplier may be used to determine the time constant. Larger values of the purge mass multiplier may give rise to longer time constants and cause the fuel fraction effect if the tank pressure control to filter out slower.

For the magnitude of the change, the algorithm may start with the difference between the current fuel fraction and the fuel fraction from before the fuel tank pressure control was initiated to get an estimate of how much fuel fraction is to be filtered out (that is, where the fuel fraction is expected to end up). This estimated amount is then multiplied by a function of the current fuel fraction to allow the total fuel quantity removed to be reduced at low fuel fractions. The delta fuel fraction is then filtered towards zero using the above-determined time constant. The final output is the difference between the filter output and the previous filter output. This value then gets subtracted from the purge fuel fraction in the fuel fraction reduction. While this value is subtracted, the normal fuel fraction continues to be updated to account for errors in the estimate of the rate of change in the actual fuel fraction.

The feed-forward filtering downward of the fuel fraction (that is, the fuel fraction reduction), may be terminated in one of two ways. In one example, the feed forward reduction may be ended after a defined number of time constants (e.g., 3 time constants). In an alternate example, the fuel fraction filtering may be discontinued when the magnitude of the expected filtered delta fuel fraction reaches a small value (e.g., lower than a threshold). In this way, the feed forward filtering action may be discontinued when the filtered fuel fraction is approaching a steady state or when the initial expected change in fuel fraction is relatively small.

The feed forward fuel fraction filtering downwards process may also be continued further, if desired. Herein, if the purge is interrupted, the purge fuel fraction reduction may resume when purge resumes, thereby avoiding a lean air-to-fuel ratio spike as the buffer continues to empty out. Alternatively, the feed forward filtering may be eliminated or terminated if the purge is shut off (or set to a purge rate lower than a threshold).

Based on the fuel fraction reduction, and the time constant for the reduction, a fuel fraction adder may be determined to reduce the value of the calculated purge fuel fraction. In one example, by periodically applying the fuel fraction adder to the calculated purge fuel fraction (e.g., every 100 msec), a feed-forward fuel fraction increase may be calculated when tank pressure control is enabled, if desired.

In this way, by delivering the fuel tank purge amount over a plurality of purge pulses based on the buffer capacity, buffer loading on each purge, as well as buffer unloading between purges is improved.

Now turning to FIG. 6, an example routine 600 is shown for a refueling operation. The routine enables the fuel tank to be depressurized before the fuel tank is refilled.

At 602, refueling conditions may be confirmed. This may include confirming that a request for fuel tank refilling has been received. In one example, refueling conditions may be considered met when a vehicle operator actuates a lid opener switch. As such, the refueling request may be received while the vehicle is moving, or not moving, and further with the engine running or not running (e.g., a key-on or key-off condition). For example, the vehicle operator may request fuel tank refueling when parked at a refueling station, or while approaching the refueling station. In response to the refueling request, at 604, it may be determined if the vehicle speed is lower than a threshold speed. In one example, it may be determined if the vehicle has come to a complete halt.

If the vehicle is not below the threshold speed, at 606, a "not ready to refuel" message may be displayed to the vehicle operator, for example, on a display device on a vehicle dashboard. If the speed is below the threshold, then at 608, the routine may start preparing the fuel vapor recovery system for the upcoming refueling event. In particular, at 608, the canister purge valve may be closed and purging of the canister to the engine intake may be disabled (if the engine is running). By closing the canister purge valve, fuel vapor spikes from the refueling event may be contained within the canister and not allowed into the engine intake, thereby reducing air-to-fuel vapor disturbances.

At 610, it may be determined whether fuel tank depressurization is required. Specifically, it may be determined if the fuel tank pressure is greater than a threshold. If yes, then at 612, a "not ready to refuel" message may be displayed to the vehicle operator and at 614, the FTIV may be opened to depressurize the fuel tank. In one example, the FTIV may be maintained open with the canister purge valve closed until the fuel tank pressure is returned within the desired range. In another example, the FTIV may be pulsed, with the canister purge valve closed. The duration and interval of the pulses may be based on the difference of the fuel tank pressure and the threshold. In another example, as previously elaborated in FIG. 5, the duration and interval of the pulses may be based on the buffer capacity, to gradually bleed fuel vapors from the fuel tank to the buffer. In this way, when the fuel tank pressure exceeds a desired limit, fuel tank vapors may be purged from the fuel tank to the canister buffer, and/or canister, to depressurize the fuel tank.

If (or when) the fuel tank pressure is below the threshold, at 616, the controller may open the refueling door latch and the FTIV. As such, the refueling door latch may be kept closed until the fuel tank pressure is below the threshold to disable access to the fuel lid, thereby disabling refueling until the fuel tank has been depressurized. At 618, after opening the refueling door latch, a "ready to fuel" message may be displayed to the vehicle operator. A vehicle operator may then open the refueling door and fuel lid to refill the fuel tank. The FTIV may remain open for the duration of the refueling operation to allow refueling vapors to be vented to the canister buffer. The canister purge valve may remain closed for this duration to not allow refueling fuel vapors to the engine intake.

At 620, it may be confirmed if refueling has been completed. In one example, it may be determined that refueling is complete when the vehicle operator has secured the fuel lid and/or closed the refueling door. A fuel lid sensor may be configured to indicate to the controller that the refueling door has been closed and/or that the fuel lid has been secured. When refueling is completed, at 622 the routine includes closing the refueling door latch to disable further fuel tank refilling. At 624, the FTIV may be closed to contain fuel tank vapors. At 626, the canister purge valve may be opened, and purging from the canister to the engine intake may be enabled when the engine is running. If the refueling operating occurred while the engine was already running, canister purging may be re-enabled after being temporarily disabled for the duration of the refueling operation. In this way, fuel tank refilling may be allowed only after fuel tank depressurization. Further, refueling operations may be coordinated with canister purging and fuel tank purging operations.

While the routines of FIGS. 4-6 illustrate purging fuel vapors from the fuel tank to the buffer for tank pressure venting, in alternate embodiments, FTIV pulsing can also be used to limit a fuel tank vacuum. By limiting a fuel tank vacuum, the potential for whistling sounds from FTIV opening during leak detection operations can be reduced. As such, this may also reduce "whoosh" sounds heard during refueling. When included, fuel tank vacuum limiting may be enabled when the fuel tank vacuum exceeds a calibrated threshold, and the vehicle is moving fast enough to mask any sounds from the FTIV. Therein, fuel tank vacuum venting may be performed with a fixed pulse time and a fixed interval between pulses. As such, fuel tank vacuum relief may not require the engine to be running or canister purge to be enabled. However, fuel tank vacuum relief may be disabled when a purge monitor, or leak detection operation, is running.

Now turning to FIG. 7, an example map 700 is shown for intermittently purging a fuel tank based on the stored fuel vapor amount in a canister buffer and a fuel tank pressure. Map 700 depicts changes in buffer loading at graph 702, changes in fuel tank pressure at graph 704, a duty cycle of the fuel tank isolation valve at graph 706, and the output of a pulse counter at graph 708.

In the depicted example, purging conditions may be confirmed at t0, and accordingly a canister purge valve (not shown) may be opened while the FTIV is maintained closed to purge fuel vapors from a canister to the engine intake. As such, the buffer loading may be a non-linear function of the canister loading, such that as the canister loading decreases, the buffer loading may also decrease. In other words, stored fuel vapors are purged from the canister to increase the canister capacity and the buffer capacity. At t1, a stored fuel vapor amount in the canister (not shown) may reach below a threshold, leading to a stored fuel vapor amount in the buffer (herein, also referred to as buffer loading) to fall below a threshold 703. Therefore at this time, the buffer capacity may be higher than a predetermined threshold capacity.

In response to the buffer loading falling below the threshold 703, between t1 and t2, the FTIV may be intermittently opened to purge fuel vapors from the fuel tank to the canister buffer. That is, the FTIV may be pulsed to bleed fuel vapors from the fuel tank to the buffer over a plurality of purge pulses. A duration 710 of each opening and an interval 711 between consecutive openings is adjusted based on a current buffer capacity and fuel tank pressure (for example, estimated just before, or at the onset of the intermittent opening, such as at t1) and a current purge flow rate. As such, the fuel tank pressure is estimated by a pressure sensor coupled to the fuel tank for estimating a flow, while the buffer capacity is estimated from an air-to-fuel ratio feedback provided by an oxygen sensor or hydrocarbon sensor coupled downstream of the canister. In the depicted example, in response to the buffer loading being lower than the threshold by a smaller amount (that is, a relatively smaller buffer capacity) and or the fuel tank pressure being higher, the duration 710 of each opening is decreased, while the interval 711 between consecutive openings is increased to purge the fuel vapors from the fuel tank over a larger number of shorter and less frequent purge pulses. As such, when the buffer and the canister have a higher initial fuel flow, the purge valve may flow less vapors, or the purge flow request may be lower. A lower purge flow rate, in turn, equates to a longer time to clean out the buffer, and/or more time to flow an equal amount of air at a lower flow rate. Thus, by adjusting the duration and interval of the openings, buffer purging can be improved. A pulse counter may count the pulses, as shown in graph 706, to monitor the ramping in of the intermittent purging of fuel tank vapors between t1 and t2.

At t2, purging of fuel vapors from the fuel tank may be completed and the FTIV may be closed. Thereafter the canister purge valve may remain open to reduce the stored amount of fuel vapors in the canister. As such, canister purging may continue until at t3, the stored fuel vapor amount in the canister is once again below the threshold, and the stored fuel vapor amount in the buffer is below threshold 703. In response to the buffer capacity being restored above a threshold capacity, between t3 and t4, the FTIV may be once again intermittently opened, or pulsed, to purge fuel vapors from the fuel tank to the canister buffer. A duration 720 of each opening and an interval 721 between consecutive openings is adjusted based on the buffer capacity, purge flow rate and the fuel tank pressure estimated at the onset of the intermittent opening (that is, at t3). Specifically, in response to the buffer loading being lower than the threshold by a higher amount (that is, a relatively larger buffer capacity) and or the fuel tank pressure being lower, the duration 720 of each opening is increased while the interval 721 between consecutive openings may be increased (as shown) or may be decreased (not shown) to purge the fuel vapors from the fuel tank over a smaller number of longer and less frequent purge pulses (as shown) or more frequent purge pulses (not shown). As elaborated previously, without the adjustment, the fuel flow rate would be lower while the purge flow rate would be higher, relative to engine conditions held constant (such as, engine speed and load). The pulse counter may count the pulses, as shown in graph 706, to monitor the ramping in of the intermittent purging of fuel tank vapors between t3 and t4.

It will be appreciated that while the depicted example illustrates intermittent purging of fuel vapors from the fuel tank to the canister only when the stored amount of fuel vapors in the buffer is lower than a threshold, in still further embodiments, the intermittent purging from the fuel tank may be initiated in response to the stored fuel vapor amount being lower than the threshold and the fuel tank pressure being higher than a threshold. Further, while the depicted example shows symmetric purge pulses for the intermittent purging between t1 and t2 as well as between t3 and t4, in alternate embodiments, the purge pulses may be asymmetric. For example, the duration and interval between consecutive openings of the FTIV may be filtered over time.

In this way, by purging fuel vapors from a fuel tank to a canister buffer based on a buffer capacity, loading of fuel vapors in the buffer can be better controlled, thereby improving the unloading of the fuel vapors and air-to-fuel ratio control. By allowing fuel vapors to be purged to the buffer only when the buffer capacity has reached below a threshold capacity, purging of the buffer can be better enabled before further loading of the buffer is allowed. By purging fuel tank vapors over a number of purge pulses interspersed based on the buffer capacity and purge flow rate, the occurrence of sudden fuel vapor spikes can be reduced, thereby reducing the likelihood of air-to-fuel ratio disturbances during purging. In this way, emissions control can be improved.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method of operating a fuel vapor recovery system, comprising, purging fuel vapors from a canister to an engine intake to reduce a stored fuel vapor amount in the canister; and intermittently purging fuel vapors from a fuel tank to the canister to increase a stored fuel vapor amount in a canister buffer, the canister including an adsorbent therein, wherein the adsorbent has a buffer region, a duration and interval of the intermittent purging based on a determination of the stored fuel vapor amount in the buffer distinct from a remainder of the adsorbent.

2. The method of claim 1, wherein the duration is further based on a fuel tank pressure.

3. The method of claim 2, wherein the fuel vapor recovery system includes a purge valve coupled between the canister and the engine intake, and an isolation valve coupled between the fuel tank and the canister, and wherein purging fuel vapors from the canister to the engine intake includes opening the purge valve and purging with the isolation valve closed.

4. The method of claim 3, wherein intermittently purging fuel vapors from the fuel tank to the canister includes intermittently opening the isolation valve.

5. The method of claim 4, wherein the duration of the intermittent purging is decreased and the interval between consecutive purgings is increased as the stored fuel vapor amount in the buffer increases.

6. The method of claim 5, wherein the duration of the intermittent purging is increased as the fuel tank pressure decreases to maintain a mass of released fuel vapors.

7. The method of claim 6, wherein purging fuel vapors from the canister to reduce the stored fuel vapor amount in the canister includes purging fuel vapors from the canister to reduce the stored fuel vapor amount in the canister buffer below a threshold.

8. The method of claim 7, wherein intermittently purging from the fuel tank includes initiating intermittently purging only if the stored fuel vapor amount in the canister buffer is below the threshold.

9. The method of claim 8, wherein intermittently purging from the fuel tank further includes intermittently purging only if the fuel tank pressure is above a first, lower threshold.

10. The method of claim 9, further comprising, if the fuel tank pressure is above a second, higher threshold, intermittently purging from the fuel tank with the purge valve closed.

11. The method of claim 1, wherein purging fuel vapors from the canister to reduce the stored fuel vapor amount in the canister includes purging fuel vapors from the canister to empty the canister.

12. The method of claim 1, wherein intermittently purging fuel vapors from a fuel tank wherein the intermittent purging includes a plurality of consecutive purge pulses, wherein the duration of the intermittent purging includes a duration from a beginning to an end of each purge pulse, and wherein the interval of the intermittent purging includes an interval from the end of a purge pulse to the beginning of an immediately following purge pulse.

13. A method of operating a fuel vapor recovery system including a fuel tank coupled to a canister through an isolation valve, comprising, purging fuel vapors from the canister to an engine intake until a stored fuel vapor amount in a canister buffer is below a threshold, the canister including an adsorbent therein, wherein the adsorbent has a buffer region; and pulsing the isolation valve to purge fuel vapors from the fuel tank to the canister to increase the stored fuel vapor amount, a duration of each pulse, and an interval between consecutive pulses adjusted based on each of a buffer capacity, purge flow rate and a fuel tank pressure at an onset of the pulsing, a duration and interval of the purging based on a determination of the stored fuel vapor amount in the buffer distinct from a remainder of the adsorbent.

14. The method of claim 13, wherein purging fuel vapors from the canister includes closing the isolation valve and opening a purge valve coupled between the canister and the engine intake.

15. The method of claim 13, further comprising, estimating a ramp-out rate of the fuel vapors based on the pulsing of the isolation valve and a filtered value of a stored amount of vapors in the buffer when concluding the pulsing, and adjusting a fuel injection to the engine based on the estimated ramp-out rate.

16. The method of claim 13, wherein the adjustment includes, as the buffer capacity decreases, decreasing the duration of each pulse and increasing the interval between consecutive pulses; and as the fuel tank pressure increases, decreasing the duration of each pulse.

17. The method of claim 13, wherein pulsing the isolation valve includes opening the isolation valve only if the stored fuel vapor amount is below the threshold.

18. The method of claim 13, wherein the fuel tank pressure is estimated by a pressure sensor positioned in the fuel tank or between the fuel tank and the isolation valve, and wherein the buffer capacity is based on an air-to-fuel ratio feedback from an oxygen sensor and/or a hydrocarbon sensor coupled downstream of the canister.

19. An engine system, comprising, an engine including an intake;

a fuel tank;

a canister coupled to the intake through a first valve and coupled to the fuel tank through a second valve, the canister including a buffer, the canister including an adsorbent therein, wherein the adsorbent has a buffer region;

a pressure sensor coupled to the fuel tank for estimating a fuel tank pressure;

an exhaust gas sensor coupled downstream of the canister for providing air-to-fuel ratio feedback, a capacity of the buffer estimated from the air-to-fuel ratio feedback; and a controller with computer readable instructions for, opening the first valve to purge fuel vapors from the canister and increase the buffer capacity; and when the buffer capacity is higher than a threshold capacity, intermittently opening the second valve to purge fuel vapors from the fuel tank to the canister buffer, a duration of each opening and an interval between consecutive openings based on the buffer capacity, purge flow rate and the fuel tank pressure at an onset of the intermittent opening, a duration and interval of the purging based on a determination of the stored fuel vapor amount in the buffer distinct from a remainder of the adsorbent.

20. The engine system of claim 19, wherein the controller is configured to, decrease the duration of each opening while increasing the interval between consecutive openings as the buffer capacity decreases, and decrease the duration of each opening as the fuel tank pressure increases above a first threshold pressure; and open the second valve for a duration while closing the first valve in response to the fuel tank pressure increasing above a second, higher threshold pressure, wherein the buffer is within the canister such that during canister loading, fuel vapors are first adsorbed within the buffer, and then when the buffer is saturated, further fuel vapors are adsorbed in the canister and during canister purging, fuel vapors are first desorbed from the canister before being desorbed from the buffer.

* * * * *